US006876959B1

(12) United States Patent
Peirce et al.

(10) Patent No.: US 6,876,959 B1
(45) Date of Patent: Apr. 5, 2005

(54) METHOD AND APPARATUS FOR HYDRAULIC FRACTIONING ANALYSIS AND DESIGN

(75) Inventors: Anthony P. Peirce, Vancouver (CA); Eduard Siebrits, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/301,961

(22) Filed: Apr. 29, 1999

(51) Int. Cl.[7] ..... G06G 7/48

(52) U.S. Cl. ..... 703/10; 703/2; 702/11; 702/12; 702/13; 702/14

(58) Field of Search ..... 703/2, 10; 702/13, 702/11, 12, 14

(56) References Cited

U.S. PATENT DOCUMENTS

| | | | | | |
|---|---|---|---|---|---|
| 4,828,028 | A | * | 5/1989 | Soliman | 367/35 |
| 4,858,130 | A | * | 8/1989 | Widrow | 702/11 |
| 5,070,457 | A | * | 12/1991 | Poulsen | 702/12 |
| 5,413,179 | A | * | 5/1995 | Scott, III | 166/308 |
| 5,659,135 | A | * | 8/1997 | Cacas | 73/152.02 |
| 5,661,698 | A | * | 8/1997 | Cacas | 367/73 |
| 5,771,170 | A | * | 6/1998 | Withers et al. | 702/16 |
| 6,076,046 | A | * | 6/2000 | Vasudevan et al. | 702/12 |
| 6,216,783 | B1 | * | 4/2001 | Hocking et al. | 166/250.1 |

OTHER PUBLICATIONS

Gohfer *Grid Oriented Hydraulic Fracture Extension Replicator*, p. 1–52, Appendix, p. 1–11, (1996) by Stim–Lab, Inc. and Marathon Oil Company.

Cade Office, *Solution Revolution Break Open Your Reserves with FracCADE*, p. 1–6, (Jan. 1998), Schlumberger Oilfield Services, Dowell, GeoQuest.

J. A. Ryder and J.A.L. Napier, *Error Analysis and Design of a Large–Scale Tabular Mining Stress Analyser*, (1985) Chamber of Mines of South Africa Research Organization.

D. A. Mendelsohn, *A Review of Hydraulic Fracture Modeling—Part I: General Concepts, 2D Models, Motivation for 3D Modeling*, p. 369–376, (Sep. 1984), Journal of Energy Resources Technology.

L. J. Wardle, *Stress Analysis of Multilayered Anisotropic Elastic Systems Subject to Rectangular Loads*, p. 1–37, (1980), CSIRO.

Sarva Jit Singh, *Static Deformation of a Transversely Isotropic Multilayered Half–Space by Surface Loads*, p. 263–273, (1986), Physics of the Earth and Planetary Interiors, 42.

Sarva Jit Singh, *Static Deformation of a Multilayered Half–Space by Internal Sources*, p. 3257–3263. (Jun. 10, 1970), Journal of Geophysical Research.

Ryosuke Sato and Mitsuhiro Matsu'ural, *Static Deformations Due to the Fault spreading over Several Layers in a Multi–Layered Medium Part I: Displacement*, p. 227–249, (Sep. 20, 1973), J. Phys. Earth, 21.

(Continued)

*Primary Examiner*—Jean R. Homere
*Assistant Examiner*—Herng-der Day
(74) *Attorney, Agent, or Firm*—Thomas O. Mitchell; Robin Nava; Brigitte L. Echols

(57) ABSTRACT

A method and apparatus for designing, monitoring or evaluating the growth of a subterranean hydraulic fracturing procedure is disclosed. The method uses techniques of analysis that are both accurate and efficient in reducing computing resources needed to process data. A computer generated method of estimation is used to determine the dimensions and shape of the hydraulic fracture. The estimate facilitates subsequent changes in fracturing parameter selection and design to maximize well performance and production. A rigorous method of evaluation is disclosed for a multi-layered or laminated petroleum reservoir. Material balance of hydraulically pumped fluids and proppant is maintained. In addition, the energy balance between the hydraulic fracture tip and the surrounding reservoir host rock is conserved.

5 Claims, 13 Drawing Sheets

OTHER PUBLICATIONS

Ernian Pan, *Static Green's Functions in MultiLayered Half-Spaces*, p. 509–521, (1997), Appl. Math. Modelling, vol. 21.

Ernian Pan, *Static Response of a Transversely Isotropic and Layered Half–Space to General Dislocation Sources*, p. 103–115, (1989), Physics of the Earth and Planetary Interiors, 58.

Ernian Pan, *Stastic Response of a Transversely Isotropic and Layered Half–Space to General Surface Loads*, p. 353–363, Physics of the Earth and Planetary Interiors, 54.

A. A. Linkova and A. A. Savitski, *An Effective Method for Multi–Layered Media with Cracks and Cavities*, p. 338–355, (1994) International Journal of Damage Mechanics, vol. 3.

Dushan B. Jovanovic, Moujahed I. Husseini and Michael A. Chinnery, *Elastic Dislocations in a Layered Half–Space—I. Basic Theory and Numerical Methods*, p. 205–217, (1974), Geophys. J. R. astr. Soc. 39.

Raymond Crampagne, Majid Ahmadpanah, and Jean–Louis Guiraud, *A Simple Method for Determining the Green's Function for a Large Class of MIC Lines Having Multilayered Dielectric Structures*, p. 82–87 (1978) IEEE.

Y. Leonard Chow, Jian Jun Yang, and Gregory E. Howard, *Complex Images for Electrostatic Field Computation in Multilayered Media*, p. 1120–1125, (1991) IEEE.

W. T. Chen, *Computation of Stresses and Displacements in a Layered Elastic Medium*, p. 775–800 (1971) Int. J. Engng Sci. vol. 9.

J.A. Ryder, *Optimal iteration schemes suitable for general non–linear boundary element modelling applications*, pp. 1079–1084, (1991), Rock Engineering Division, COMRO, South Africa.

Ari Ben–Menahem and Sarva Jit Singh, *Multipolar Elastic Fields in a Layered Half Space*, p. 1519–1572 (1968) Bulletin of the Seismological Society of America, vol. 58.

* cited by examiner

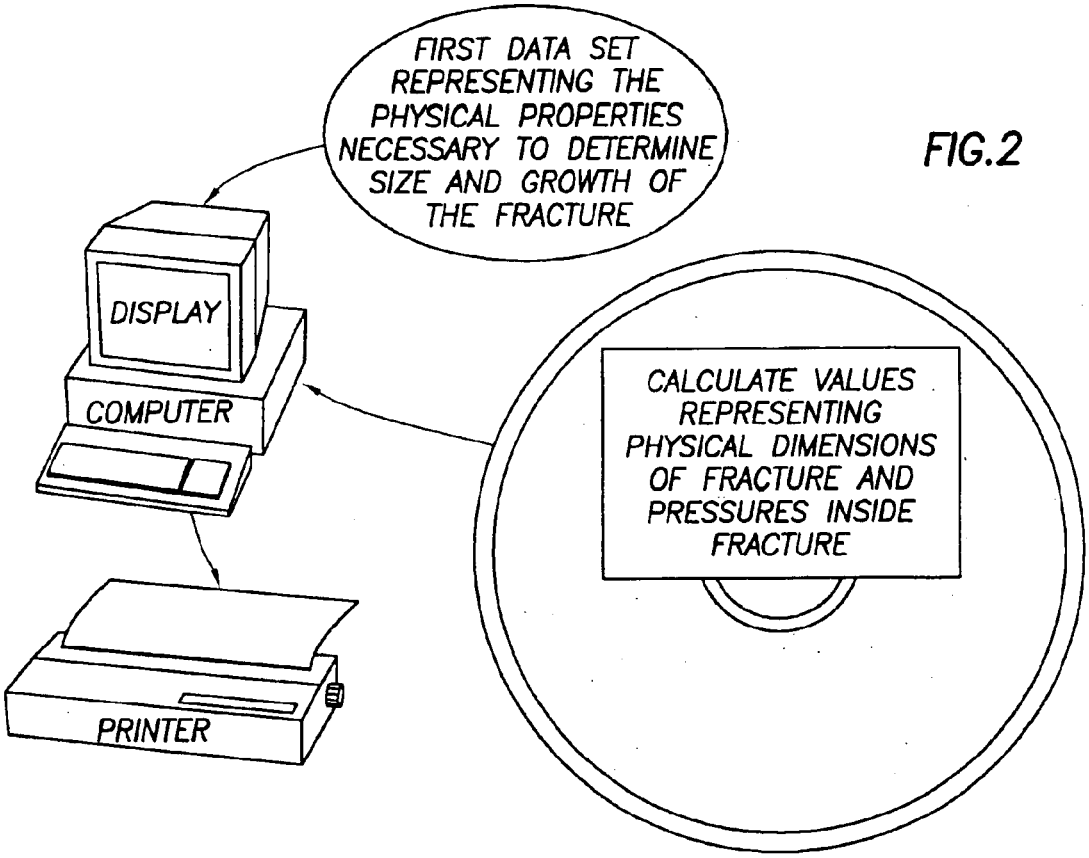
FIG.2
FIG.3
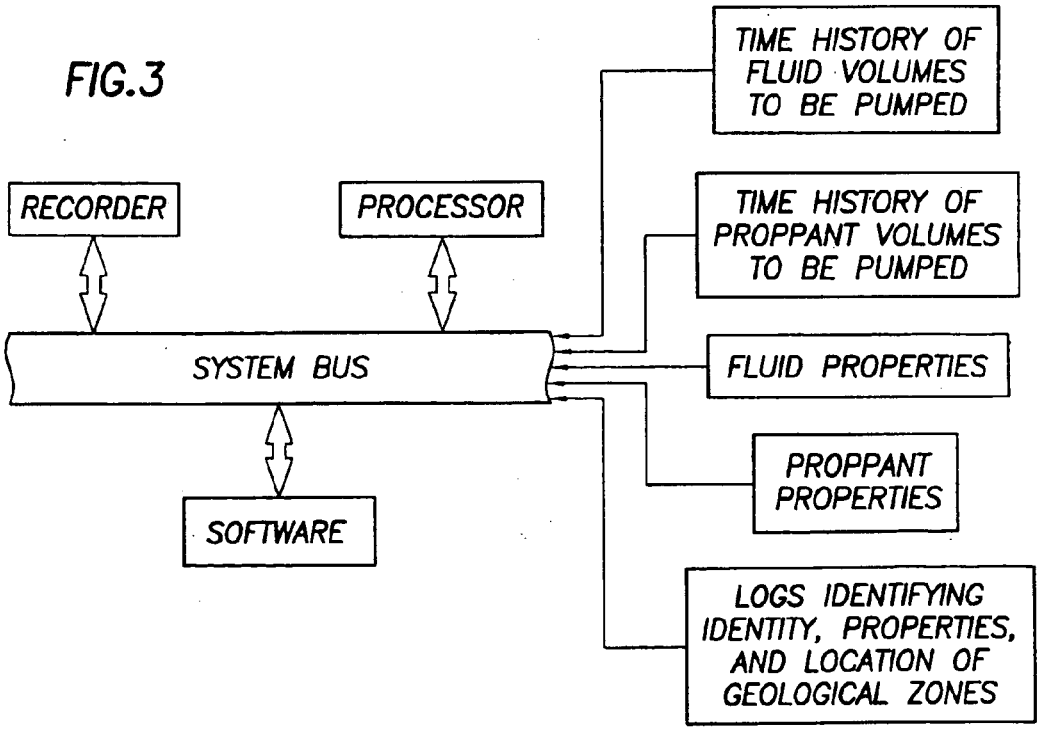

23
PUMP TRUCK
24
25
26
27
SHALE
30
SANDSTONE
OIL/GAS PAY ZONE
28
29
27
SHALE
OIL/GAS PAY ZONE
WATER-BEARING ZONE

FIG. 13
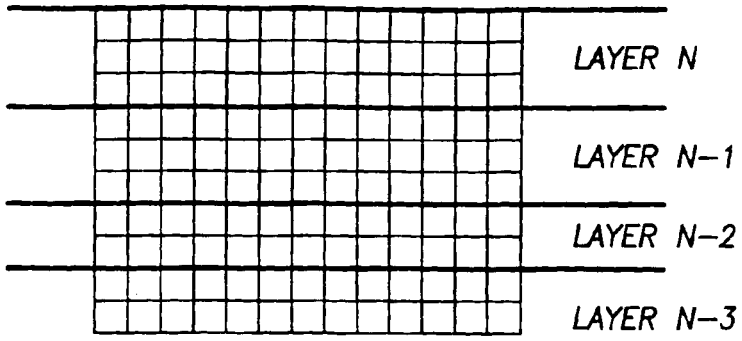
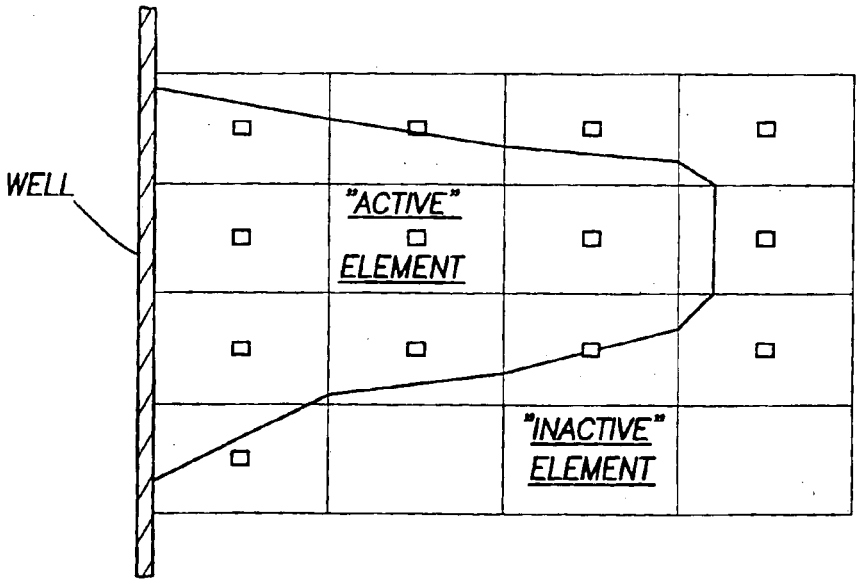
FIG. 14
FIG. 15
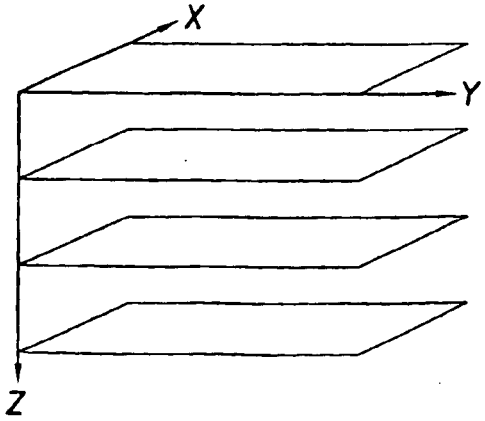

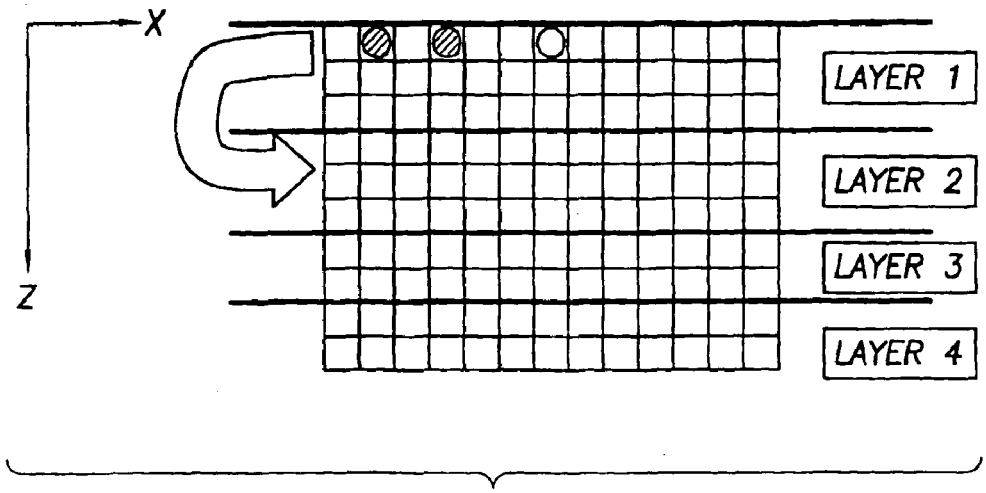
FIG. 16
FIG. 17
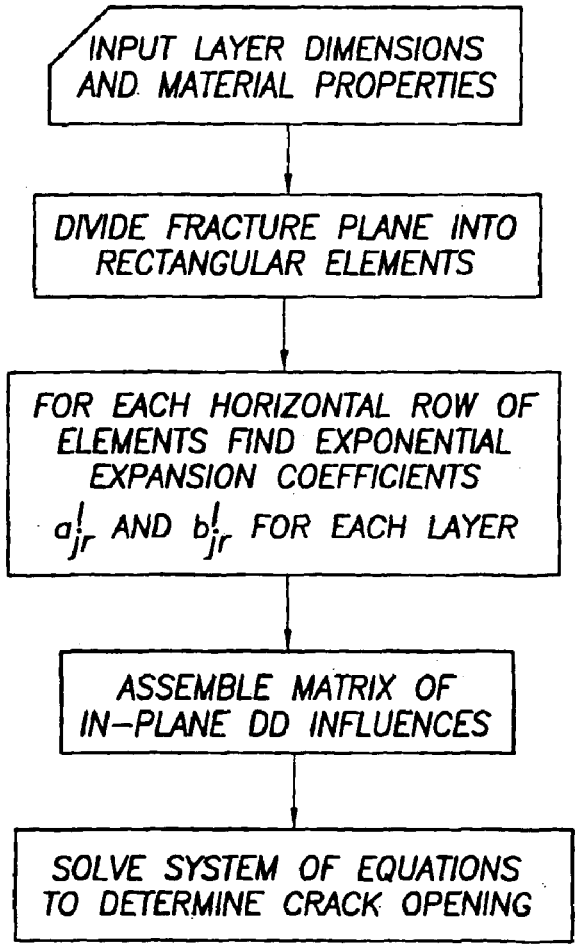

METHOD AND APPARATUS FOR HYDRAULIC FRACTIONING ANALYSIS AND DESIGN

BACKGROUND OF THE INVENTION

1. Field of the Invention

This invention relates to an apparatus and method used to design, monitor and evaluate petroleum reservoir fracturing. The invention employs a method to estimate, from available data, the shape of a fracture by way of a numerical simulator which replicates the physical behavior of the hydraulic fracturing process. The size and features of a fracture may be controlled to maximize well productivity following fracturing of the well.

2. Description of the Prior Art

In hydraulic fracturing, thousands of gallons of fluid are forced under high pressure underground to split open the rock in a subterranean formation. Proppant or propping agent is carried into the fracture by the viscosified fluid, and deposited into the fracture. Proppant provides a permeable flow channel for formation fluids such as oil and gas to travel to the wellbore and above the ground surface.

Fracturing involves many variables, including: viscosity of the fracturing fluid, rate of leak-off of fracturing fluid into the reservoir, proppant carrying capacity of the fluid, viscosity of the fluid as a function of temperature, time history of fluid volumes (i.e. the amount of fluid pumped over a given period of time), time history of proppant volumes, fluid physical constants, proppant properties, and the geological properties of various zones in the reservoir.

Currently, fracturing design is accomplished using PC-based programs such as, for example, Schlumberger's FracCADE simulator (FracCADE is a trademark of Schlumberger Technology Corporation). Some of the currently available software has the ability to use what is known in the industry as "pseudo" three dimensional (P3D) hydraulic fracture simulators. Pseudo (P3D) methods are capable of estimating height growth for single fracture geometry's, but cannot accurately represent fracture geometry in more complex treatments that involve multiple geological layers underground (known as "laminated" reservoirs).

Other software has the ability to use what is known in the industry as planar three dimensional ("PL3D") hydraulic fracture simulators. Methods employing PL3D accurately take into account geologic layers. One such program, known commercially as GOHFER (GOHFER is believed to be a trademark of Stim-Lab and the Marathon Oil Company), provides grid oriented hydraulic fracture replication capabilities. This grid oriented program, and its mode of operation, is seen in FIG. 7. As the front of the fracture moves forward, calculations are made in which each individual grid is either "on" or "off" depending upon whether or not more than half of the individual grid is "covered" by the advancing fracture as it moves outward from the wellbore. If more than one-half of the grid element is covered, then the element is estimated to be fully active. The disadvantage of this system of estimating fracture growth is that it produces too much numerical noise at the fracture tip, and hence in the output data.

Other PL3D methods of simulating fractures include the TerraFrac three dimensional fracturing simulator (TerraFrac is a trademark of the TerraTek Company). This simulator operates as seen in FIG. 8, using estimates that are based upon a method of a moving mesh. This method shows less noise than the GOHFER method, because it uses triangle shaped elements which form a tighter fit with the advancing fracture front. However, it recalculates the entire mesh element set again and again, using large amounts of computing power.

What is needed in the industry is a software implemented method that is capable of accurately and efficiently estimating a fracturing event—before the event, during the event, or after the event. A method and process is needed that is capable of properly accounting for all kinds of layer contrasts, including elastic properties, layer toughness, leakoff parameters, and confining stress; A method is needed which can estimate pinch point scenarios, estimate runaway height growth, and join or separate fractures in the same plane. A process is needed that does not require periodic "re-meshing", as typically is required with many prior art moving mesh techniques. A technique in which only the fracture front is tracked is highly desirable. Further, a system which is not limited to only an "on/off" binary system for elements would be beneficial. A system that facilitates rapid updates of the solution at each step is needed.

SUMMARY OF THE INVENTION

A petroleum reservoir PL3D hydraulic fracturing modeling apparatus and method is disclosed that incorporates a complete hydraulic fracturing analysis system for the design, monitoring, or evaluation of a petroleum reservoir. The invention uses industry accepted techniques of analysis. A computer generated estimate showing fracture growth in physical dimensions is presented. This evaluation is used to determine the dimensions and shape of the hydraulic fracture that may be formed under a given set of parameters and conditions.

The method includes a rigorous hydraulic fracturing estimation method for a geologically laminated petroleum reservoir. The method uses industry accepted hydraulic fracturing analysis techniques. Techniques accepted in the industry include: (1) material balance of hydraulically pumped fluids and proppant, (2) energy balance of the fracture tip with the surrounding reservoir host rock, and (3) equilibrium of the stresses and strains in the layered petroleum reservoir due to forced introduction of the hydraulic fracture into the reservoir.

A method and device is disclosed in which the device comprises a means for storing instructions, said instructions adapted to be executed by a processor of a computer. Further, the instructions when executed by the processor should be capable of executing a process comprising the steps of obtaining a first data set, the first data set comprising at least one of the following: time history of fluid volumes, time history of proppant volumes, fluid properties, proppant properties, and geological properties. Additionally, the method includes a means for providing the first data set to a computer, the computer having a processor capable of executing instructions, the computer further having electronic storage means with stored equations comprising hydraulic fracturing relationships. A further step relates to computing by said processor a first set of values by manipulating said first data set using said stored equations. It is possible then to determine from said first set of values dimensions of a hydraulic fracture, the dimensions including fracture height and length, fracture width, and fluid pressures as a function of time. In a further embodiment, the step of converting said first set of values into a set of output data is performed, the output data representing fracture dimensions and fluid pressures as a function of pumping time.

Further, one may then display the output data on a computer monitor, transmit the data by satellite or remote link to another location for further processing or review, or even include a feedback control loop to control the fracturing event in real time.

In one embodiment, a step of determining from said first set of values the dimensions of a hydraulic fracture using a mesh of elements is performed. In that step, the dimensions, including fracture height and length, fracture width and fluid pressures as a function of time, are ascertained. Further, the invention may deploy elements which are capable of being only partially active, further wherein the recalculation of fully active elements is not required during determination of the first set of values. The invention more accurately and efficiently estimates fracture growth and orientation.

BRIEF DESCRIPTION OF THE DRAWINGS

FIG. 2 shows a first data set and a CD-ROM or other magnetic media upon which is written instructions that can be read by the computer in executing the method of the invention;

FIG. 3 depicts the data that is provided to the system bus of the microprocessor;

FIG. 13 shows a single fracture from FIG. 12, broken into square elements for simulation purposes;

FIG. 14 shows active and inactive elements for the current fracture;

FIG. 15 reveals typical layer interfaces and the coordinate system used later in this document;

FIG. 16 shows a typical numerical mesh with layers and their interfaces;

FIG. 17 is a flow diagram;

DETAILED DESCRIPTION

A petroleum reservoir hydraulic fracturing modeling apparatus and method is disclosed which incorporates a complete hydraulic fracturing analysis system for the design, monitoring, or evaluation of petroleum reservoir hydraulic fracturing performance, using industry accepted techniques of analysis. A computer generated estimation method is used to determine the dimensions and shape of the hydraulic fracture in a computerized methodology with maximum efficiency. A primary goal is to maximize well performance and production.

The method includes a rigorous hydraulic fracturing model for a geologically laminated petroleum reservoir, and it uses industry accepted hydraulic fracturing analysis techniques. Techniques accepted in the industry include: (1) material balance of hydraulically pumped fluids and proppant, (2) energy balance of the fracture tip with the surrounding reservoir host rock, and (3) equilibrium of the stresses and strains in the layered petroleum reservoir due to forced introduction of the hydraulic fracture into the reservoir.

Figure 1:
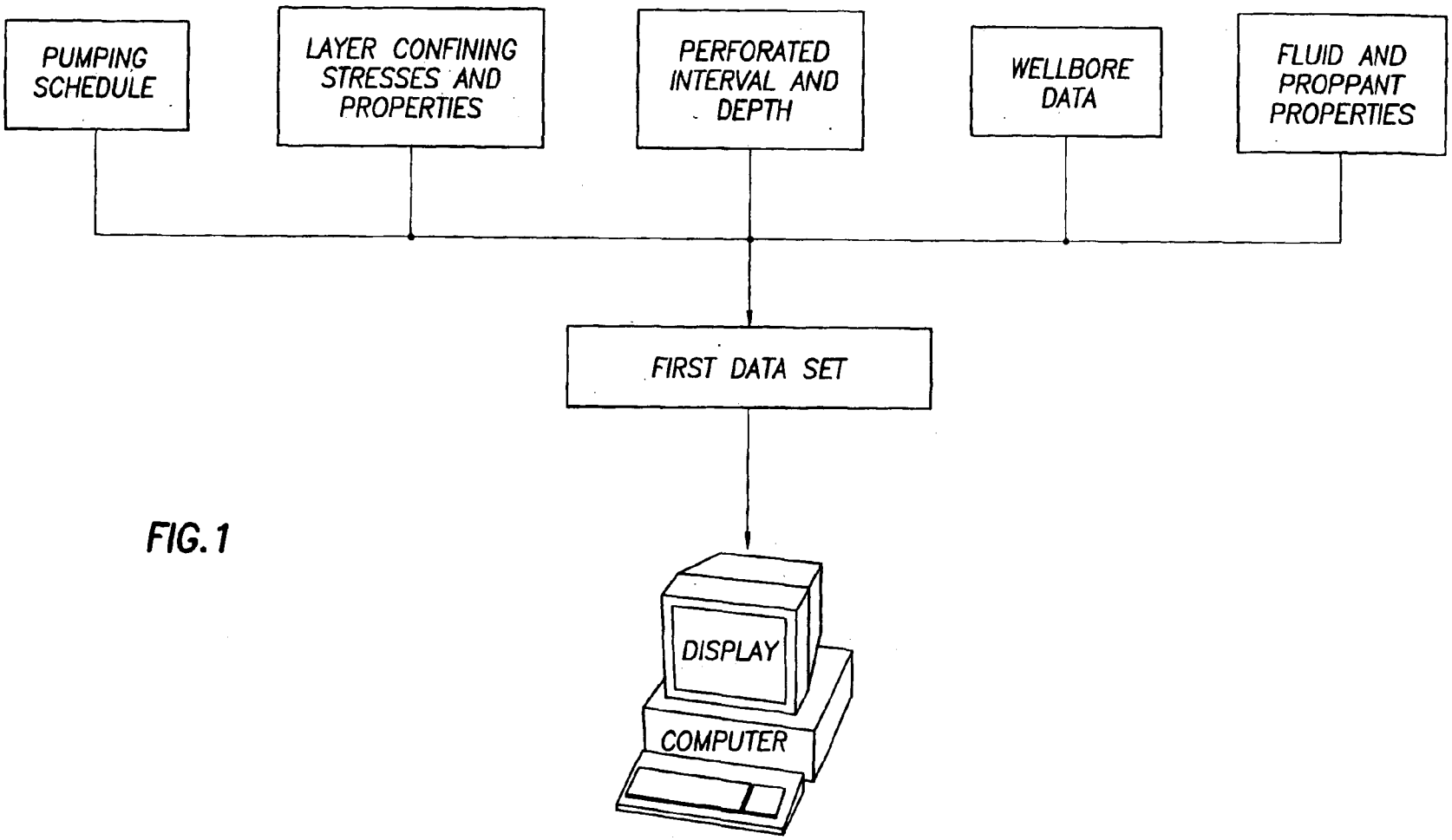
FIG. 1 shows the actual physical data that is provided by way of a first data set into a computer.

Turning now to FIG. 1, a pumping schedule, the reservoir layer confining stresses and properties, a perforated interval and depth, wellbore data, and fluid and proppant properties are provided in a first data set to a computer. In FIG. 2, one can see the input of the first data set representing the physical properties necessary to determine size and growth of the fracture. That data is provided to the computer, and combined with the software instructions (shown here as CD-ROM based) to facilitate the calculation of values representing physical dimensions of the fracture and pressures inside the fracture. Also shown is an output format to a printer.

FIG. 3 shows how time history and other pertinent data is provided to the system bus of the computer and thereby made available for coordination with the processor, recorder, and software.

Figure 4:
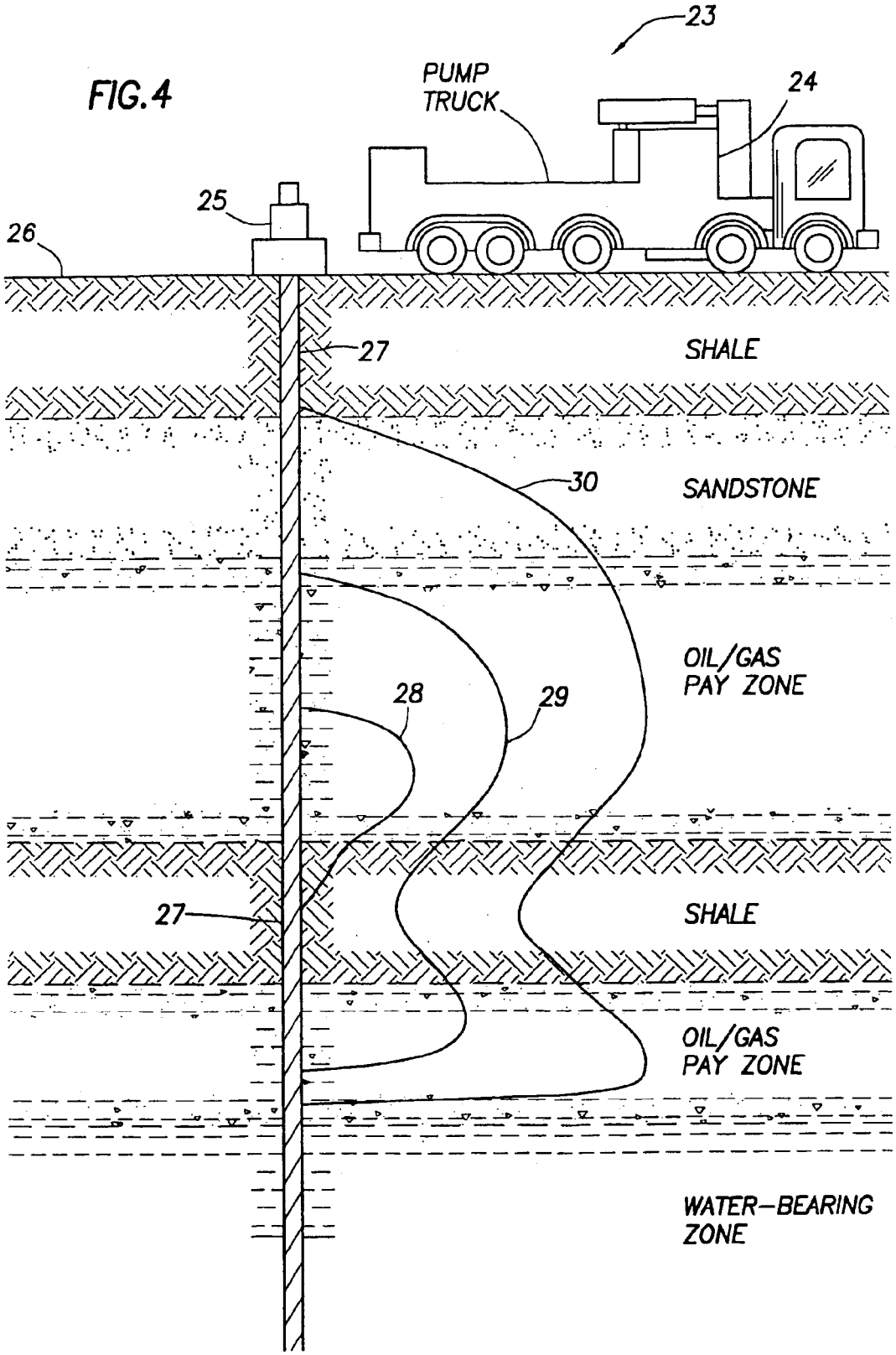
FIG. 4 shows a laminated geological reservoir divided into zones or layers, and the fracture boundary and fluid boundaries at a particular time.

In FIG. 4, a reservoir 23 is shown. Pumping truck 24 provides fluid at high pressures and flow rates to wellhead 25, which is operably connected to the wellbore 27 at or near the ground surface 26. The Figure shows the fracture boundary 30 at a particular time. Two fracture fluid boundaries 28 and 29 also are indicated in the Figure. The fluid boundaries reveal separate types or compositions of pumped fluid.

Various zones or laminations of underground geological forms can be seen. In FIG. 4, the fracture preferably is stopped prior to the water bearing zone seen at the lower portion of FIG. 4.

Figure 5:
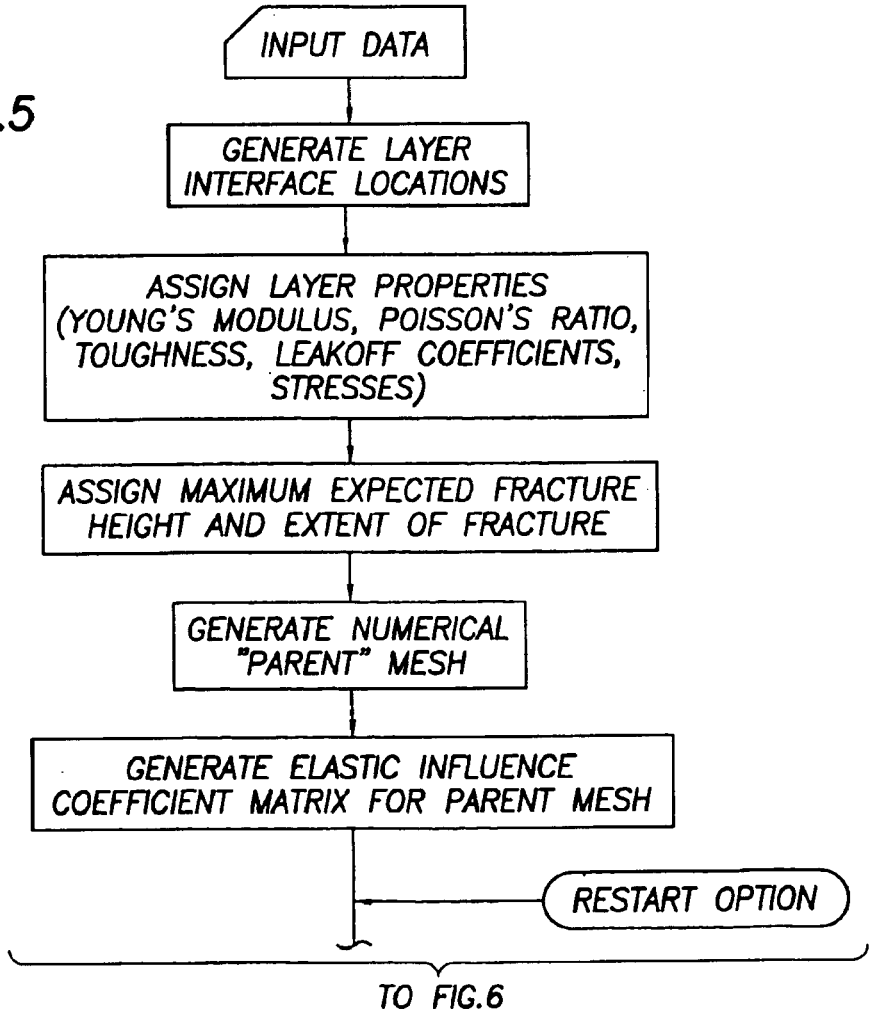
FIG. 5 is a flowchart of the fracture growth process.
Figure 6:
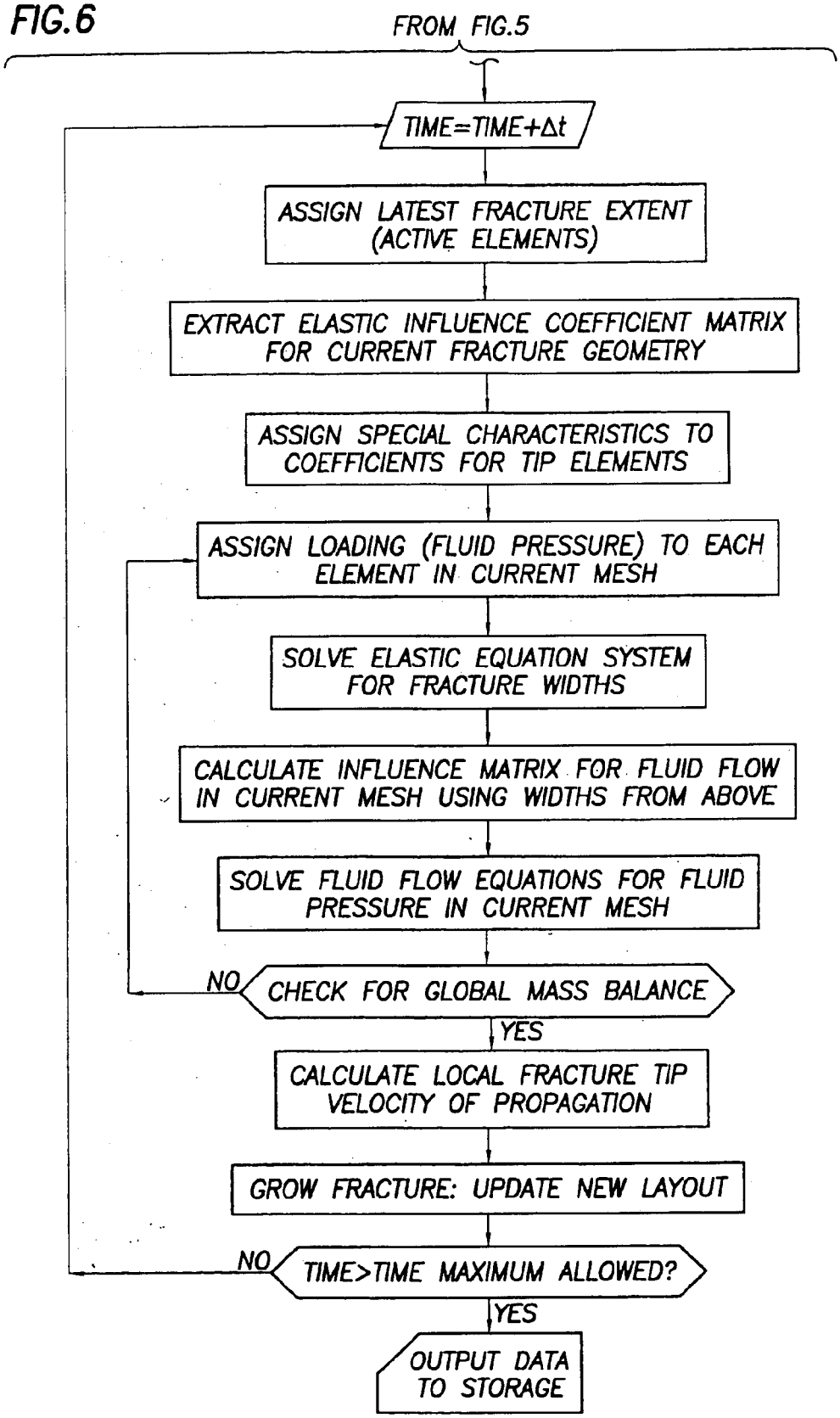
FIG. 6 is a continuation of the flowchart shown in FIG. 5.

FIGS. 5 and 6 show a flowchart of software implemented steps of this invention wherein input data is provided to generate layer interface locations. Next, layer properties are assigned, followed by assignment of maximum expected fracture height and length. Then, a numerical "parent" mesh is generated. An elastic influence coefficient matrix is generated next, followed by the assignment of the current time step. The steps are followed as set forth in FIG. 6, and then a check step for global mass balance is performed. If no mass balance is achieved, then the loop is repeated until convergence of the solution is obtained. After updating the new fracture layout, the time is checked, and if it has reached a user-defined limit, the simulation is terminated and the output data is sent to storage.

Figure 7:
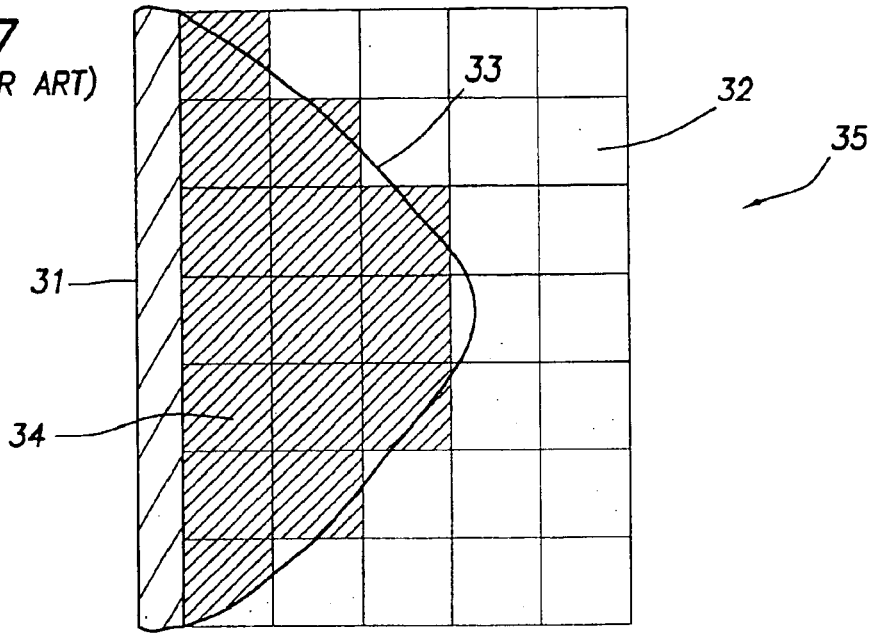
FIG.7 (PRIOR ART)
FIG. 7 reveals the method of calculation using a prior art "on/off" mesh method.

FIG. 7 shows binary mesh method 35 of the prior art employing a regular mesh with wellbore 31. The active elements of the mesh are shown. Fully active element 34 and inactive element 32 can be seen in the Figure. The methodology followed in this prior art example is that if the leading edge 33 covers more than 50% of the element, then the element is considered to be fully active, and if less than 50%, it is considered to be inactive. Thus, it is a binary system of approximating the function.

Figure 8:
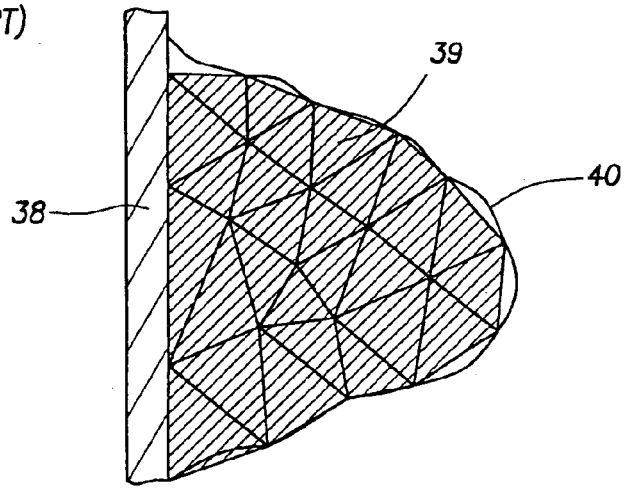
FIG.8 (PRIOR ART)
FIG. 8 depicts a prior art method of calculating fracture growth requiring recalculation of triangular element mesh parameters at each time step.

FIG. 8 shows another prior art methodology in which triangular elements are used to closely match the fracture front. Wellbore 38 issues a fracture having triangular element 39 and fracture leading edge 40. In this methodology, a closer "fit" is formed between the elements and the fracture leading edge, thereby forming somewhat improved approximation over the prior art method of FIG. 7. However, prior art methods employing the method of FIG. 8 require recalculation, or "re-meshing", after a number of time steps. Such recalculation requires interpolation and very large amounts of computing power and time, which is a significant disadvantage of this method.

Figure 9:
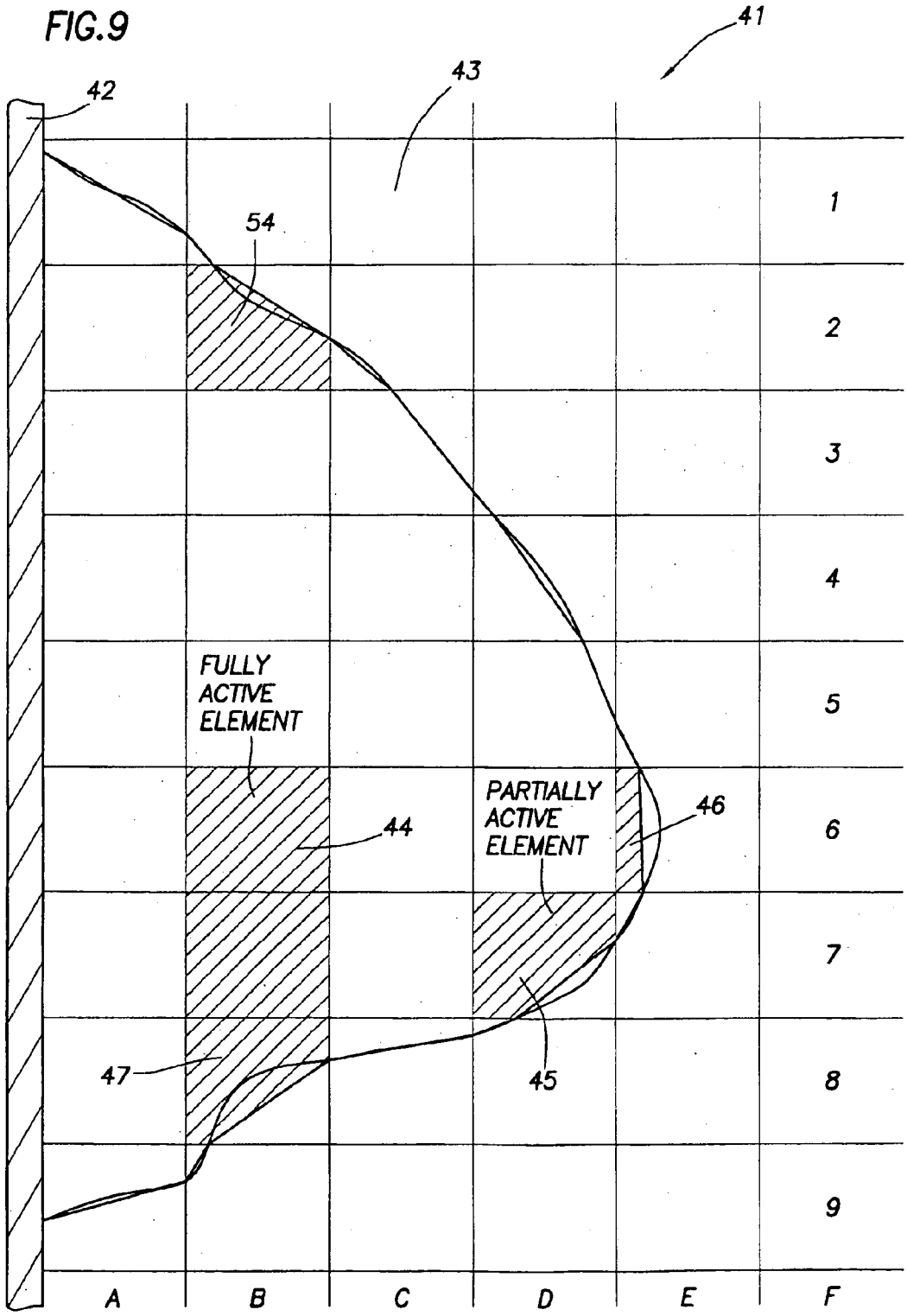
FIG. 9 shows a method of this invention which is capable of recognizing and using partially active elements to estimate the growth and propagation of a fracture.

In FIG. 9, the partial element methodology of this invention is shown. Partial element methodology 41 shows a wellbore 42 from which a fracture grows. An inactive element 43 is seen, and a fully active element 44 also is shown. Notably, literature reference 14 below describes an example of partial elements as applied in the mining industry to model tabular excavations. The partial element methodology of this invention is different, however, and is applied in a completely different context. For example, the current invention applies to fracture growth from a wellbore, not to excavations in the mining industry. There are many considerations that apply to mining that do not apply to fracturing. Further, another difference between this invention and the procedure disclosed in reference 14 is that the reference applies to fixed shapes, not to moving boundaries, as in the invention of this application.

Figure 10:
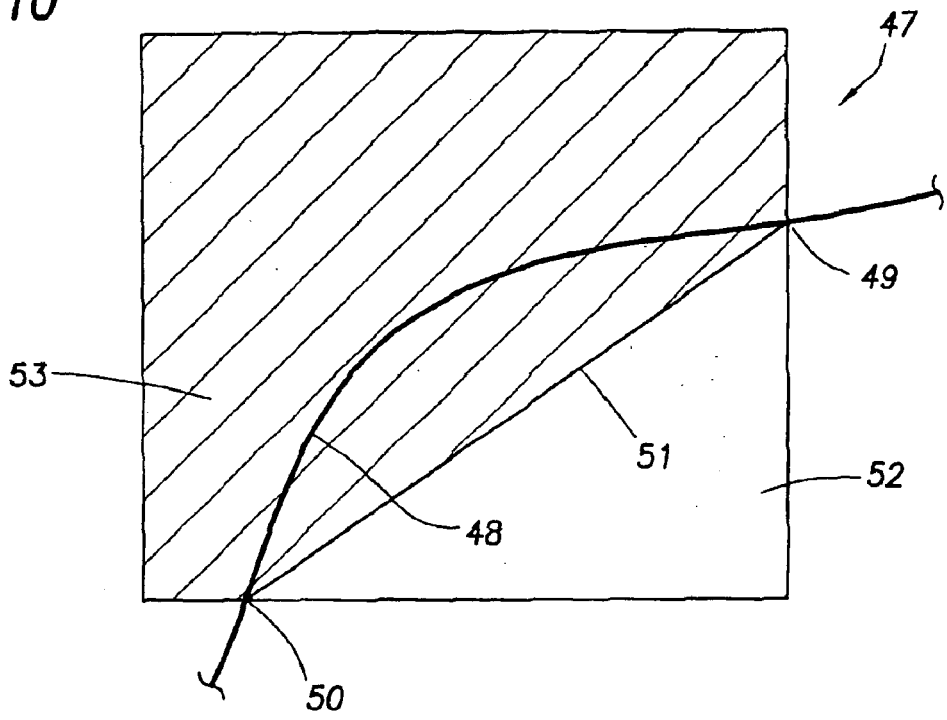
FIG. 10 is a close-up or expanded view of grid element 47 from FIG. 9.
Figure 11:
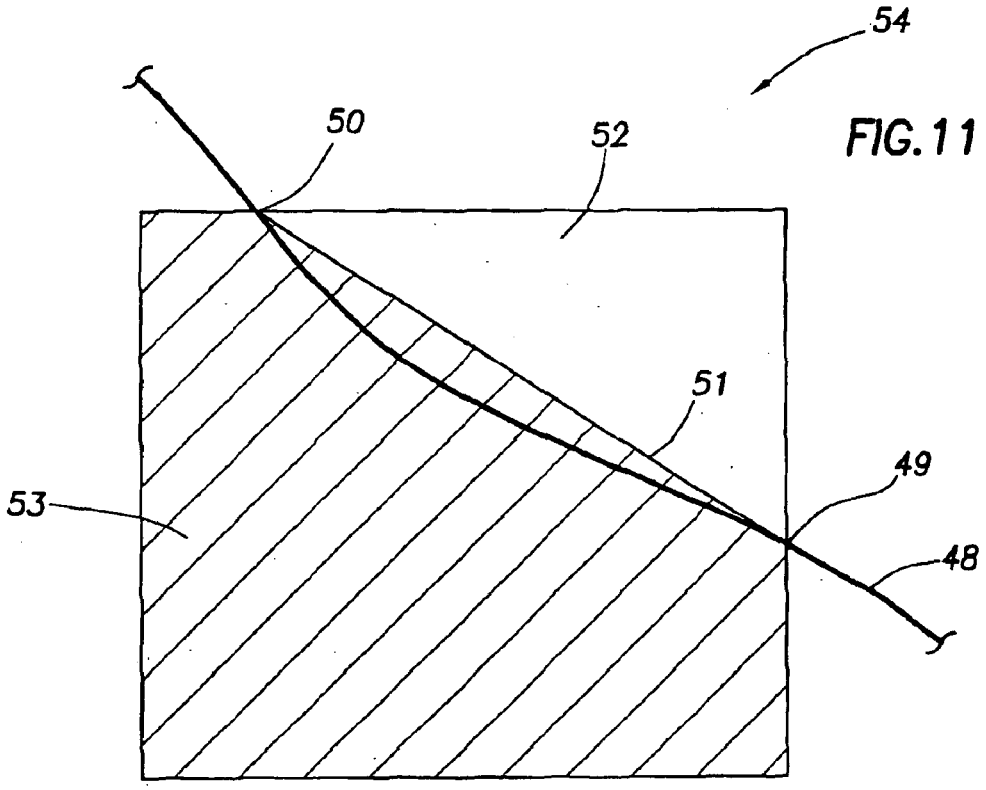
FIG. 11 is an expanded view of grid element 54 of FIG. 9.

Partially active elements 45 and 46 show how an element may be considered only partially active or activated in this invention. FIG. 10 shows a close up of partially active element 47 having fracture leading edge 48 with crossing points 49 and 50, respectively. Straight line 51 is erected between the crossing points, and it forms the boundary for the active portion of the element 53 and the inactive portion of the element 52. FIG. 11 likewise shows many of the same features for element 54 of FIG. 9.

FIGS. 12–20 are to be described in detail in the further detailed description set forth below.

The computer components shown here are those which may be purchased and which are commercially available in the industry. Minimum PC requirements are a 200 MHz processor, comprising about 16 MB RAM, and 100 MB of hard drive space. Most commercially available personal computers meeting these specifications will be sufficient to practice the invention.

A computer programmer of skill in the art, upon reviewing this specification and drawings, could construct a program to carry out the steps of the method. Once such instructions are placed on magnetic media and made available to the processor of a computer having the specifications set forth above, the method of the invention will be executable. The data input may be by hand, from logs, via communication ports or channels, or by any other means which serves to provide actual data for the steps of the inventive method. Data may comprise surface pumping measurements, output from monitoring equipment, surface microprocessor or computers, or even downhole data transmission devices. In some cases, data could be provided from proppant hoppers, fracturing fluid tanks, mixing equipment, and the like, to be used in the process. A local storage device may receive the output of the inventive method, or it may be displayed on a monitor. Additionally, output may be comprised of a visual or graphical display, and may be sent to a printer, plotter, or storage device as needed.

Further Detailed Description

The numerical algorithm employed in this invention comprises an efficient technique to determine the local width of a hydraulic fracture due to local pressure applied to the fracture faces by the injection of hydraulic fluid and proppant into the fracture. Further, a method to track the dimensions and width of said fracture as it grows as a function of time is shown. The hydraulic fracture(s) may span any number of layers in a laminated reservoir, with the restriction that all layers must be parallel to each other, as depicted for example in FIG. 12. Layers may be inclined at any angle to the horizontal.

Figure 12:
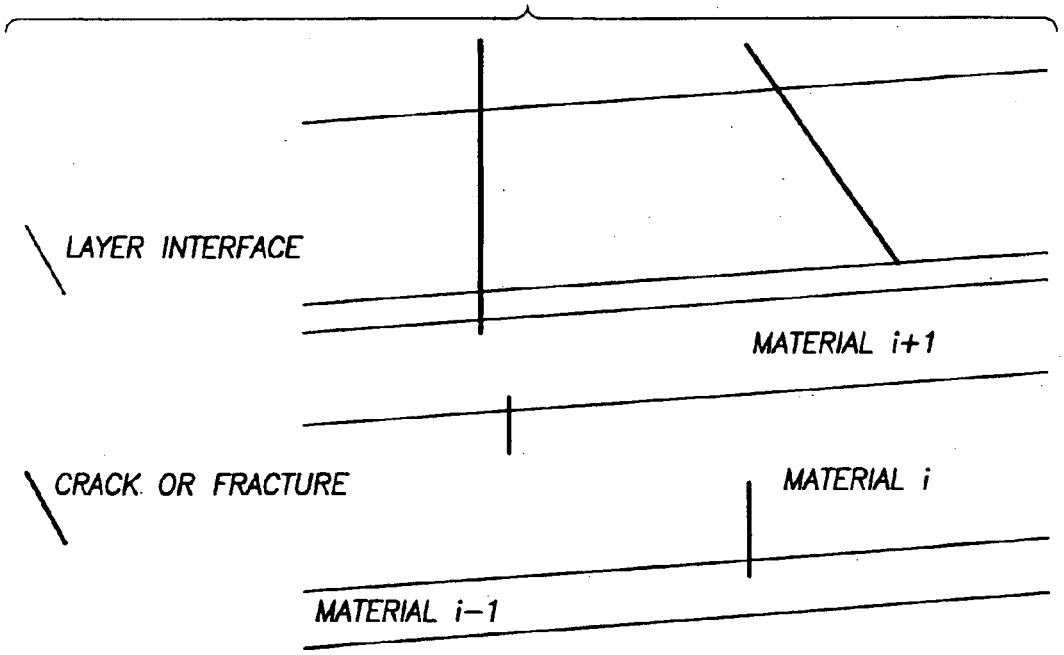
FIG. 12 shows a typical cross-section through a laminated reservoir containing multiple hydraulic fractures which the model in this invention can simulate.

FIG. 12 shows a section through multiple hydraulic fractures in a layered reservoir. The calculation of the fracture width due to the pressure from the injected fluids and proppant mixture is determined by taking into account, accurately and efficiently, the physical properties of each layer comprising the laminated reservoir. The technique used to calculate the relationship between the layered reservoir and the growing hydraulic fracture is based on a well-established numerical technique called the Displacement Discontinuity Boundary Element Method (hereafter "DD"). The method is extended to enable efficient and accurate calculation of the physical effects of layering in the reservoir by the use of a Fourier Transform Method, whereby the relations between stress and strain in the layered reservoir are determined. The numerical method assumes that each hydraulic fracture is divided into a regular mesh of rectangular elements, as depicted in FIG. 13, wherein each numerical element contains its own unique properties. Such properties include applied fluid and proppant pressure, fluid and proppant propagation direction and velocity, local reservoir properties, stress-strain relations, and fracture width.

FIG. 13 shows a numerical mesh of elements subdividing the fracture surface for purposes of calculation. In cases where the numerical element coincides with the fracture edge or tip (see FIG. 14), certain additional information is uniquely defined to such elements. For example, such information may include the local velocity of propagation of the fracture tip, the special relationship between the fluid in the fracture and the surrounding layered reservoir, and how the fluid and reservoir physically interact with each other. This interaction is accounted for by means of special properties assigned to the tip elements, comprising the interaction between a fluid-filled fracture and the host material it is fracturing.

FIG. 14 reveals a fracture outline on a numerical mesh. Each numerical element depicted in FIG. 13 or 14 relates to every other element in the numerical mesh by means of special mathematical relationships. We refer to elements as: (1) sending or source elements, and (2) receiver elements. A source element sends a signal representing a mathematical relationship to a receiver element. The signal in our case is the applied fluid pressure in that portion of the fracture. The receiver signal comprises the stress and strain experienced at the receiver location due to the applied pressure at the source element location. Many of these signals between source and receiver element are duplicated in the numerical mesh, and in these cases, special algorithms are designed to dramatically minimize the volume of storage required, so that only unique signals between different elements need to be stored.

The signals between each unique pair of receiver and source elements are stored in the computer memory or on physical storage device in a matrix. The hydraulic fracture propagation numerical method is designed so that the fracture propagates in a finite number of time steps. At each time step, the signal matrix is invoked, extracting those signals which are active over the part of the numerical mesh that is covered by the current configuration of the hydraulic fracture. This matrix is then used to build a system of numerical equations that are solved for the fracture width at the current time—at each active element location.

The solution of the equation system is accomplished using an extremely efficient numerical iterative solution technique, referred to as the LID Iterative Equation Solver. Incorporated by reference herein is reference 15, which discloses the LID Iterative Equation Solver. This solver has been specifically designed to solve this type of equation system in a very efficient and accurate manner.

During each fracture propagation step, another matrix of signals is constructed, the matrix comprising the physical behavior of the fluid in the hydraulic fracture, which relates the local fluid pressure to the local fracture width. This system of equations is also solved iteratively for local fluid pressures at each time step.

The combined system of equations must be coupled together in an efficient manner, so that they feed off each other until a balanced solution of fluid pressure and fracture width is obtained at each time step. This coupling between the two equation systems is accomplished by means of a special numerical algorithm that efficiently and accurately ensures that the correct solution is obtained. The entire system is designed to ensure that no fluid or proppant is unaccounted for in any time step.

The above process is repeated at each time step, thereby allowing the calculation of the way in which the fracture grows as a function of time. At each time step, the fracture width and fracture pressure on each active element. A complete description of the process of the propagation of a hydraulic fracture is thus obtained.

Solutions of the multi-layer equilibrium equations are provided. A three-dimensional body is assumed. The theory also applies to the two-dimensional cases (plane strain, plane stress, antiplane strain). The method provides an efficient way of determining the solution to the equilibrium equations:

$$\sigma_{ij,j}+b_i=0 \tag{1}$$

for a transversely isotropic elastic medium with a stress strain relationship given by:

$$\sigma_{ij}=C_{ijkl}\epsilon_{kl} \tag{2}$$

In Equation (1) and (2) the index notation is used. In this standard notation, a repeated literal index in any term of an expression implies summation. Therefore, in equation (1) $\sigma_{ij,j}$ means $\sigma_{ij,j}=\sigma_{i1,1}+\rho_{i2,2}+\rho_{i3,3}$ since it is assumed a 3D body.

The comma preceding an index denotes partial differentiation with respect to that variable represented by that index.; $u_{i,j}$ thus denotes $\partial u_j \div \partial x_j$. The notation used in Equation (1) is consequently a shortcut for describing the following equations:

$$\frac{\partial\sigma_{xx}}{\partial x}+\frac{\partial\sigma_{xy}}{\partial y}+\frac{\partial\sigma_{xz}}{\partial z}+b_x=0$$

-continued $$\frac{\partial\sigma_{yx}}{\partial x}+\frac{\partial\sigma_{yy}}{\partial y}+\frac{\partial\sigma_{yz}}{\partial z}+b_y=0$$

$$\frac{\partial\sigma_{zx}}{\partial x}+\frac{\partial\sigma_{zy}}{\partial y}+\frac{\partial\sigma_{zz}}{\partial z}+b_z=0$$

In the case of a transversely isotropic three-dimensional elastic medium, there are five independent material constants. The strain components in (2) are given by $$\epsilon_{kl}=\tfrac{1}{2}(u_{k,l}+u_{l,k}) \tag{3}$$

For a medium comprising multiple parallel layers each of which is homogeneous (see FIG. 15), it is possible to obtain a solution to the governing equations (1)–(3) by means of the Fourier Transform. FIG. 15 represents a schematic showing multiple parallel layers in three-dimensional case.

By substituting (3) and (2) into (1) and by taking the two-dimensional Fourier Transform with respect to x and y:

$$\hat{u}_j(m,n,\bar{z})=\int_{-\infty}^{\infty}\int_{-\infty}^{\infty}e^{i(mx+ny)}u_j(x,y,z)\,dx\,dy \tag{4}$$

of the resulting equilibrium equations in terms of the displacements, we obtain a system of ordinary differential equations in the independent variable z. This system of ordinary differential equations determines the Fourier Transforms of displacement components $u_x$, $u_y$, and $u_x$:

$$L(C_{ijkl})\begin{bmatrix}\hat{u}_x\\ \hat{u}_y\\ \hat{u}_z\end{bmatrix}=\begin{bmatrix}\hat{b}_x\\ \hat{b}_y\\ \hat{b}_z\end{bmatrix} \tag{5}$$

For a layered material, there is a system of differential equations of the form (5) for each layer, each of whose coefficients are determined by the material properties of the layer. It is possible to solve the system of differential equations for a typical layer 1 to obtain the general solution to the r th displacement components in the form:

$$\hat{u}_r^l=\sum_j d_{jr}^l e^{a_j^l kz}A_j^l(k) \tag{6}$$

where $k=\sqrt{m^{2+n^2}}$

In the case of repeated roots of the characteristic equation associated with (5), which occurs for the important case of isotropic layers, the system (5) has the general solution:

$$\hat{u}_r^l=\sum_j (d_{jr}^l+f_{jr}^l z)e^{a_j^l kz}A_j^l(k) \tag{7}$$

Here $d_{jr}^l$ and $f_{jr}^l$ are constants that depend on the material constants of the layer, the $a_j^l$ are the roots of the characteristic equation for the system of ordinary differential equations, and the $A_j^l(k)$are free parameters of the solution that are determined by the forcing terms $b_l$ in (1) and the interface conditions prescribed at the boundary between each of the layers (e.g. bonded, frictionless, etc.).

Substituting these displacement components into the stress strain law (2), we can obtain the corresponding stress components: $\hat{\sigma}_{xx}$, $\hat{\sigma}_{yy}$, $\hat{\sigma}_{zz}$, $\hat{\sigma}_{xy}$, $\hat{\sigma}_{xz}$, and $\hat{\sigma}_{yz}$, which can be expressed in the form:

$$\hat{\sigma}^l_{pq} = \sum_j (s^l_{jpq}) e^{\alpha^l_j kz} A^l_j(k) \tag{8}$$

In the case of repeated roots the stress components assume the form:

$$\hat{\sigma}^l_{pq} = \sum_j (s^l_{jpq} + t^l_{jpq} kz) e^{\alpha^l_j kz} A^l_j(k) \tag{9}$$

For each layer and for each sending DD element located at a particular z coordinate, there are a set of six parameters $A_j^l(k)$ that need to be determined from a system of algebraic equations that express the required body forces and boundary conditions in the model. Once the $A_j^l(k)$ have been determined, it is possible to calculate the influences of any DD having the same z component on any receiving point in any layer by taking the inverse Fourier Transform:

$$u_j = \frac{1}{(2\pi)^2} \int_{-\infty}^{\infty} \int_{-\infty}^{\infty} e^{-i(mx+ny)} \hat{u}_j \, dm \, dn \tag{10}$$

of (6)–(9).

One of the major computational problems in the procedure outlined above is the inversion process represented by (10), which involves the numerical inversion of a two-dimensional Fourier Transform for each sending-receiving pair of DD elements. The method we propose uses an exponential approximation of the spectral solution coefficients $A_j^l(k)$of the form:

$$A^l_j(k) - A^l_j(\infty) \approx \sum_j a^l_{jr} e^{b^l_{jr} k} \tag{11}$$

Here $A_j^l(\infty)$ represents the high frequency components of the spectrum of the solution, which represents the singular part of the solution in real space.

The inversion process can be achieved by evaluating integrals of the form:

$$I^{pl}_j = \frac{1}{(2\pi)^2} \int_{-\infty}^{\infty} \int_{-\infty}^{\infty} [A^l_j(k) - A^l_j(\infty)] k^p e^{\alpha^l_j kz} e^{-i(mx+ny)} dm \, dn \text{ or}$$

$$I^{pl}_j \approx \frac{1}{(2\pi)^2} \sum_j a^l_{jr} \int_{-\infty}^{\infty} \int_{-\infty}^{\infty} k^p e^{k(\alpha^l_j x + b^l_{jr})} e^{-i(mx+ny)} dm \, dn \tag{12}$$

which can be evaluated in a closed form. The shifted components $a_j^l z - b_{jr}^l$ in (12) represent a finite number of complex images that approximate what would be an L-fold infinite Fourier Series (for L layers) that would be required to represent the Green's function in a closed form using the method of images. Typically three or four complex images suffice to give a high order of accuracy.

The expressions of the form (12) are not much more complicated than the pair-wise DD influences that apply for a homogeneous elastic medium. One difference in this case is that for each sending DD element, the expansion coefficients $a_{jr}^l$ and $b_{jr}^l$ for each layer need to be determined by solving the appropriate set of algebraic equations and performing the exponential fit (11) of these coefficients. Once these coefficients have been determined we have a very efficient procedure to determine the influences between DD elements.

For a regular array of DD elements there is an additional saving that can be exploited. In this case only the influence of a single sending DD element at each horizon (i.e., z level) needs to be determined in order to determine the whole influence matrix. For example, the source DD elements in layer 1 denoted by the cross-hatched, hatched, and unshaded circles each have the same set of layer 2 exponential expansion coefficients $a_{jr}^l$ and $b_{jr}^l$. (see FIG. 16). Below is a description of how to construct arbitrarily oriented DD influence coefficients.

A DD influence at a specified point within a given layer is constructed by constructing a pseudo interface parallel to the layering across which there can be a jump in the displacement field. To construct a normal DD a jump in $u_z$ is specified, whereas to construct a shear or ride DD a jump in $u_x$ or $u_y$ is specified. This technique limits the orientation of DD components to be aligned with the pseudo interface that is parallel to the layering.

It is, however, desirable to have DD components that specify jumps in the displacement field which are across interfaces that are not parallel to the layering in the material. In particular, for hydraulic fracturing problems in the petroleum industry, it is important to be able to model vertical fracture planes that are perpendicular to the horizontally layered material. In this case, and for arbitrarily oriented DDs, it is possible to construct a DD field of a desired orientation, by utilizing the duality relationship between the stresses due to a force discontinuity (or point force) and the displacements due to a displacement discontinuity. The solution to a force discontinuity in the r th direction can be constructed by taking $b_r = \delta(x, y, z)F_r$, where $\delta(x, y, z)$ represents the Dirac delta function.

Having obtained the stresses due to a force discontinuity:

$$\hat{\sigma}_y = \hat{y}_{ijr} F_r \tag{13}$$

it is possible to determine the displacements due to a DD according to the following duality relation:

$$\hat{u}_r = \hat{y}_{ijr} D_{ij} \tag{14}$$

One key component is to construct a planar Green's function or influence matrix, which represents the influences of all the DDs that lie in a vertical fracture plane. The influence matrix will only represent the mutual influences on one another of DDs that lie in the fracture plane. However, it will implicitly contain the information about the variations in material properties due to the layering. FIG. 17 depicts the basic algorithm.

A reduced influence matrix can be constructed by any numerical method, including that proposed above, which can represent rigorously the changes in material properties between the layers. For example, the finite element method or a boundary integral method in which elements are placed on the interfaces between material layers. The in-plane influence coefficients would be calculated by means of the following procedure.

To calculate the influence of the ij th in-plane DD on the kl th DD anywhere else on the fracture plane, the value of the ij th DD would be assigned a value of unity and all ink the other fracture plane DDs would be set equal to zero. The boundary integral or finite element solution on the interfaces between the material layers would then be determined so as to ensure that there is compatibility in the displacements between the material layers as well as a balance in the forces between the layers at the interface. Once numerical solution has been calculated for the whole problem, the corresponding stresses on each of the in-plane DD elements can be evaluated to determine the in-plane stress influence of that unit DD on all the other DDs in the fracture plane. By repeating this process for each of the DDs that lie in the fracture plane, it is possible to determine the in-plane influence representing the effect that each DD in the plane has on any of the other in-plane DDs. By allowing the interface solution values to react to the sending DD element, the effect of the layers has been incorporated implicitly into this abbreviated set of influence coefficients.

The numerical procedure outlined to construct the desired in-plane influence matrix would take a considerable amount of time to compute. Indeed, such a process would likely exclude the possibility of real time processing, but could conceivably be performed in a batch mode prior to the desired simulation being performed. The semi-analytic method outlined above would be much more efficient, as the fully three-dimensional (or two-dimensional, in the case of plane strain or plane stress), problem that needs to be solved to calculate the influence of each DD element has been effectively reduced to a one-dimensional one.

Numerical models for multi-layered materials require that the interface between each material type is numerically "stitched" together by means of elements. For example, a boundary element method implementation would require that each interface between different material types is discretized into elements. A finite element or finite difference method implementation would require that the entire domain is discretized into elements. In the current patent, the material interfaces are indirectly taken into account without the requirement of explicitly including elements away from the surface of the crack or fracture. The implication thereof, is a dramatic reduction in the number of equations to be solved, with a commensurate dramatic decrease in computer processing time. In addition, accuracy of the solution is maintained. One aspect of this invention which distinguishes it from previous work is that it is capable of solving problems in multi-layered elastic materials with arbitrarily inclined multiple cracks or fractures in two or three-dimensional space.

Another aspect of this invention which distinguishes it from prior art is that elements can intersect layers. This is accomplished by taking special care of the mathematical stress/strain relationships across interfaces in such a way as to obtain the correct physical response for the element which is located across the interface(s).

FIG. 17 shows a flowchart of the present invention in which input layer dimensions and physical properties are provided. Then, the fracture plane is divided into elements, and for each horizontal row of elements, the calculations are performed. Further, one may assemble the matrix of in-plane DD influences and then solve the equations to determine an estimate of the crack opening.

References 1–3 below are classic papers that establish the Fourier scheme to solve elastic multi-layer problems, but do not utilize the inversion scheme proposed here. In references 1 and 2, a propagator matrix approach is suggested to solve the system of algebraic equations necessary for the Fourier scheme, but this particular scheme will become unstable for problems with many layers.

References 4 and 5 use exponential approximation for inversion. The methods in those references do not give rise to the complex images generated by the algorithm presented in this invention that so efficiently represent the effect of many layers. Reference 5 extends the propagator approach used in references 1 and 2 to solve the algebraic equations of the Fourier method. Reference 5 discloses an inversion scheme that is an integral part of the propagator method.

This method involves an exponential approximation, similar to that proposed in this patent, but it is applied to only one part of the propagator equations. As a result, a least squares fit of many terms (more than 50) is required to yield reasonable results using the teachings of this reference. Apart from stability issues involved with exponential fitting, the large number of terms would probably be less efficient than using direct numerical integration for inversion. The exponential fit of the spectral coefficients that we propose involves less than five terms.

References 6 through 10 extend the Fourier method to transversely isotropic media. References 7–10 use the propagator matrix for solving the algebraic equations, while reference 6 below proposes direct solution. All these methods of solution would be numerically unstable for problems with many thick layers. While reference 10 proposes numerical inversion using continued fractions, little mention is made of the inversion process.

References 11 and 12 describe methodologies for multi-layer dielectric materials containing point electrical charges, or line charge distributions aligned parallel to interfaces (i.e., with different Green's functions to those used in elasticity).

Reference 13 describes a so-called "sweeping" algorithm to solve layered systems. The method disclosed in reference 13 is essentially the classic block LU decomposition-for a block tri-diagonal system. In this invention, we use this algorithm to obtain a stable solution of the algebraic equations that determine the Fourier spectral coefficients in each of the layers. This method is particularly effective for problems in which the layers are thick or the wave-numbers are large.

It is recognized that other mathematical relationships may be used in the invention to achieve the same commercial or physical purpose. While not employing exactly the same equations, such methods are within the scope of the invention as set forth herein.

Figure 18:
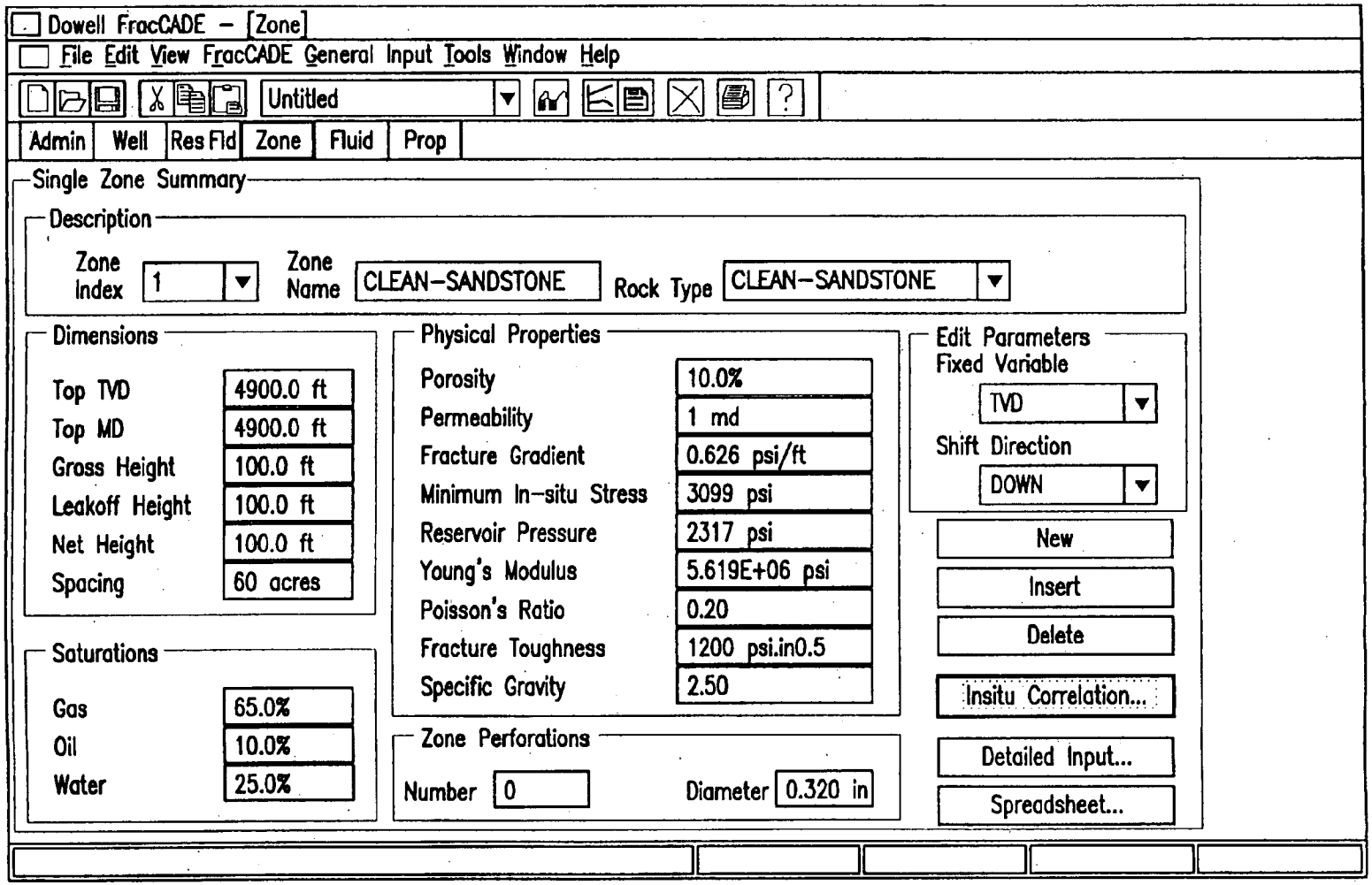
FIG. 18 is a sample FracCADE zone input screen showing how an operator can select the zones which apply to the wellbore under consideration.
Figure 19:
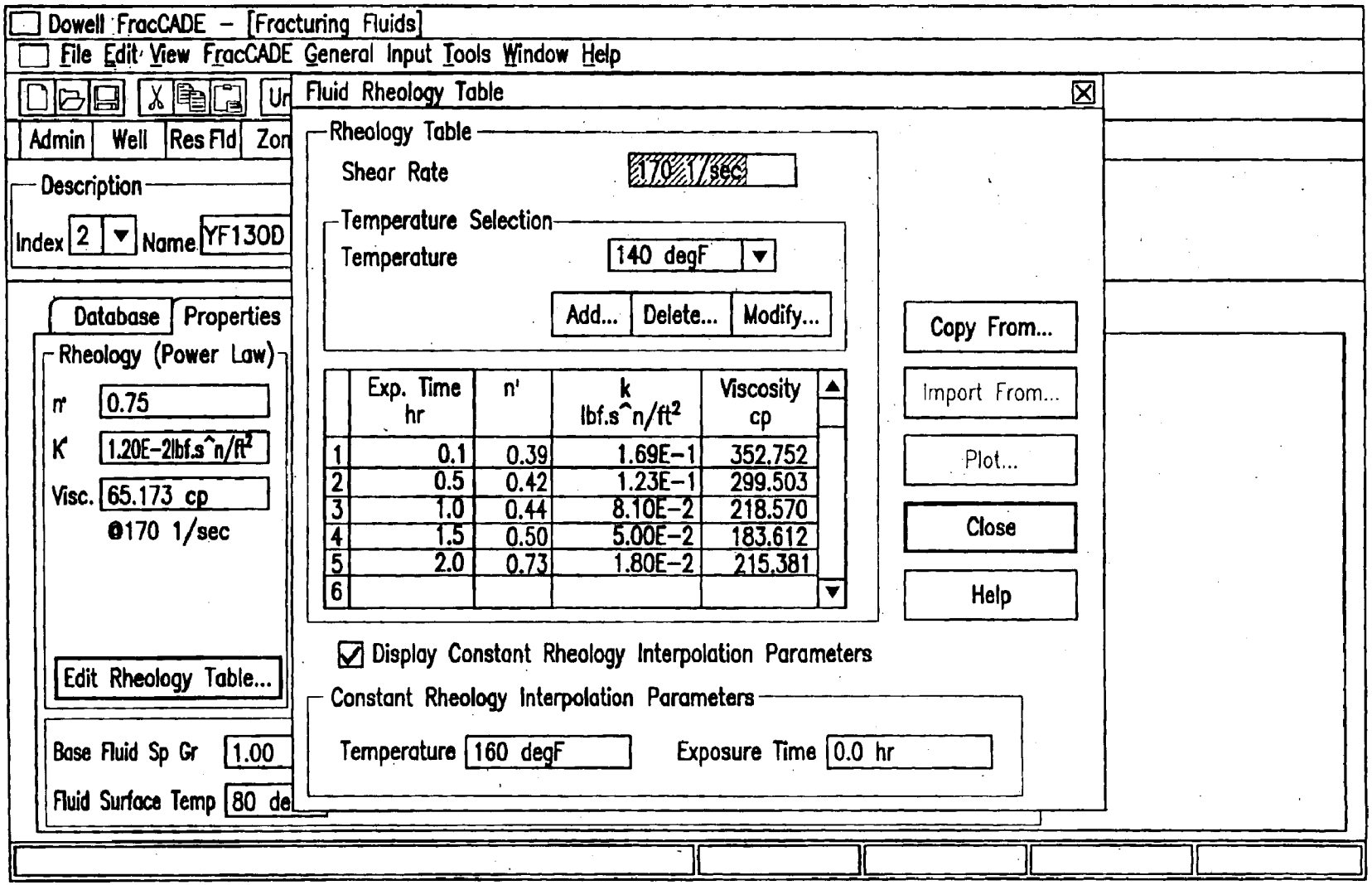
FIG. 19 shows a FracCADE fluids input screen.
Figure 20:
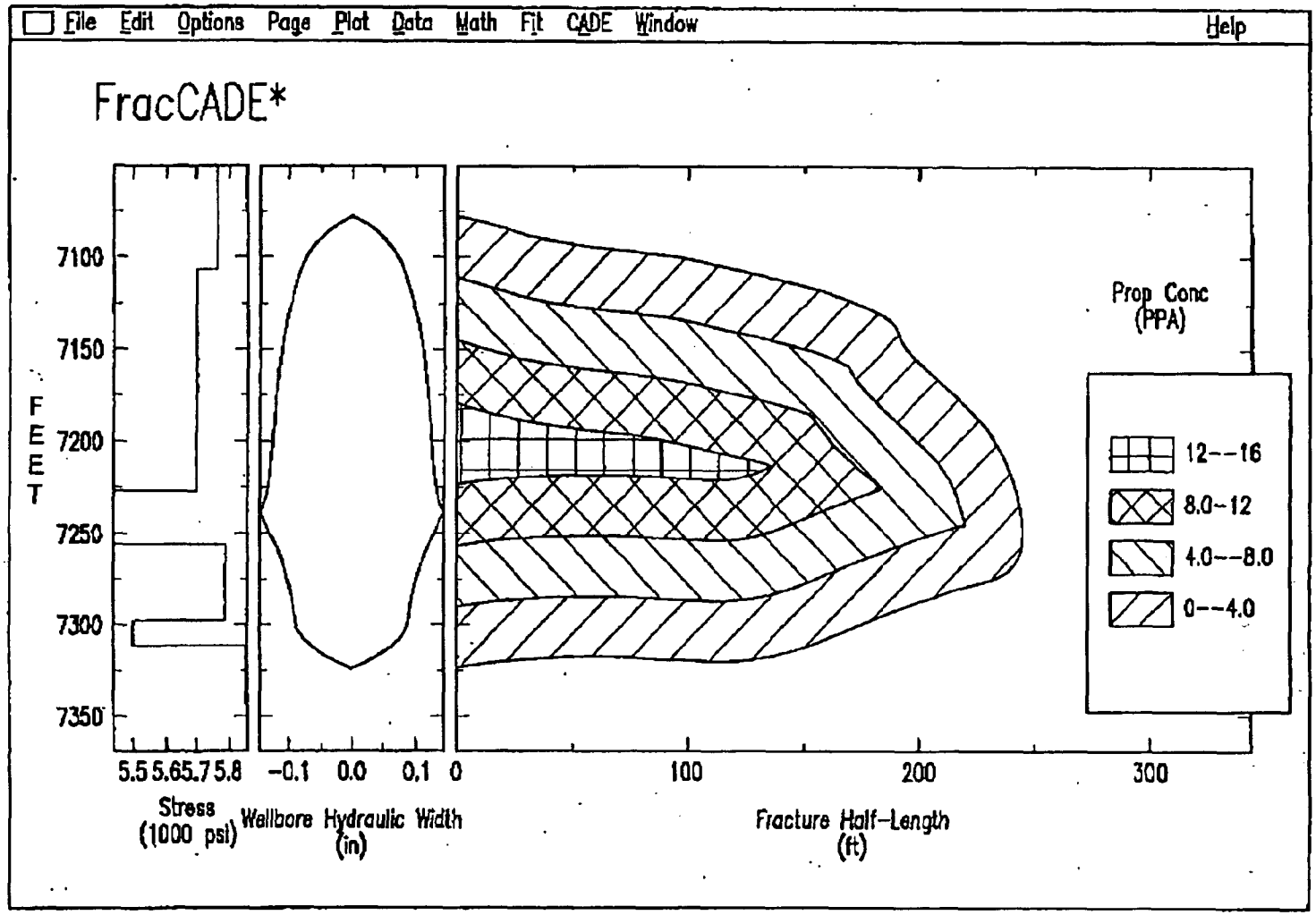
FIG. 20 reveals a typical display of a fracture profile with proppant dissemination confining stresses, and fracture width along the wellbore shown.

In FIG. 18, a sample FracCADE zone screen is shown whereby an operator of the software can choose the formation laminations that apply to the wellbore under examination in carrying out the inventive method. FIG. 19 shows the FracCADE fracturing fluids screen having a fluids rheology table with physical parameters necessary to carry out the inventive method. FIG. 20 shows a sample output (as on a computer monitor or printed) which includes stress, fracture width, and proppant distribution. The fracture profile and proppant concentration levels achieved in each portion of the fracture are shown. Further, the fracture width is provided for designing and evaluating fracture growth. The following references are hereby incorporated by reference as if set forth here in their entirety:

1. Ben-Menahem, A. and Singh, S. J. 1968. *Multipolar elastic fields in a layered half space*. Bull. Seism. Soc. Am. 58(5). 1,519–72.
2. Singh, S. J. 1970. *Static deformation of a multi-layered half-space by internal sources*. J. Geophys. Res. 75(17). 3,257–63.
3. Chen, W. T. 1971. *Computation of stresses and displacements in a layered elastic medium*. Int. J. Engng Sci. vol. 9. 775–800.
4. Sato, R. and Matsu'ura, M. 1973. *Static deformations due to the fault spreading over several layers in a multi-layered medium Part I: Displacement*. J. Phys. Earth. 21. 227–249.
5. Jovanovich, D. B., Husseini, M. I. and Chinnery, M. A. 1974. *Elastic dislocations in a layered half-space—I. Basic theory and numerical methods. Geophys*. J. R. astro. Soc. 39. 205–217.

6. Wardle, L. J. 1980. *Stress analysis of multilayered anisotropic elastic systems subject to rectangular loads*. CSIRO Aust. Div. Appl. Geomech. Tech. paper no. 33. 1–37.
7. Singh, S. J. 1986. *Static deformation of a transversely isotropic multilayered half-space by surface loads*. Physics of the Earth and Planetary Interiors. 42. 263–273.
8. Pan, E. 1989. *Static response of a transversely isotropic and layered half-space to general surface loads*. Physics of the Earth and Planetary Interiors. 54. 353–363.
9. Pan, E. 1989. *Static response of a transversely isotropic and layered half-space to general dislocation sources. Physics of the Earth and Planetary Interiors*. 58. 103–117.
10. Pan, E. 1997. *Static Green's functions in multilayered half spaces*. Appl. Math. Modelling. 21. 509–521.
11. Chow, Y. L., Yang, J. J. and Howard, G. E. 1991. *Complex images for electrostatic field computation in multilayered media*. IEEE Trans. on Microwave Theory and Techniques. vol. 39. no. 7. 1120–25.
12. Crampagne, R., Ahmadpanah, M. and Guiraud, J.-L. 1978. *A simple method for determining the Green's function for a class of MIC lines having multilayered dielectric structures. IEEE Trans. on Microwave Theory and Techniques*. vol. MTT-26. No. 2. 82–87.
13. Linkov, A. M. , Linkova, A. A. and Savitski, A. A. 1994. *An effective method for milti-layered media with cracks and cavitis*. Int. J. of Damage Mech. 3. 338–355.
14. Ryder, J. A. and Napier, J. A. L. 1985. *Error Analysis and Design of a Large Scale Tabular Mining Stress Analyzer*. Proc: Fifth Int. Conf. On Num. Meth. In Geomech. Nagoya. 1549–1555.
15. J. A. Ryder, Cairns, E. G. Beer, J. R. Booker, and J. P. Carter, *Optimal Iteration Schemes Suitable for General Non-linear Boundary Element Modelling Applications*: Proceedings of the 7th international conference on Computer Methods and advances in Geomechanics, Balkema Rotterdam, 1991.

Other embodiments of this invention beyond the exact specification of the examples set forth herein have been suggested and still others may occur to those skilled in the art upon a reading and understanding of this specification. It is intended that all such embodiments be included within the scope of this invention.

What is claimed is:

1. A method of designing a hydraulic fracture of a well, comprising:

(a) obtaining a first data set, the first data set comprising:
time history of fluid volumes for pumping,
time history of proppant volumes for pumping,
fluid properties,
proppant properties, and
logs, (b) providing the first data set to a computer, the computer having a processor capable of executing instructions, the computer further having electronic storage means with stored equations comprising hydraulic fracturing relationships, (c) computing by said processor a first set of values by manipulating said fist data set using said stored equations, (d) determining from said first set of values the dimensions of a hydraulic fracture using a mesh of elements, said dimensions including fracture height and length, fracture width and fluid pressures as a function of time, wherein the elements are capable of being only partially active, further wherein recalculation of fully active elements is not required during computing of said first set of values, (e) converting said first set of values into a set of output data, the output data representing fracture dimensions and pressure as a function of pumping time, (f) displaying the output data.

2. A device comprising means for storing instructions, said instructions adapted to be executed by a processor of a computer, said instructions when executed by the processor executing a process comprising the steps of (a) obtaining a first data set, the first data set comprising:
time history of fluid volumes for pumping,
time history of proppant volumes for pumping,
fluid properties,
proppant properties, and
logs of geological information, (b) providing the first data set to a computer, the computer having a processor capable of executing instructions, the computer further having electronic storage means with stored equations comprising hydraulic fracturing relationships, (c) computing by said processor a first set of values by manipulating said first data set using said stored equations, (d) determining from said first set of values the dimensions of a hydraulic fracture using a mesh of elements, said dimensions including fracture height and length, fracture width and fluid pressures as a function of time, wherein the elements are capable of being only parity active, further wherein recalculation of fully active elements is not required during computing of said first set of values, (e) converting said first set of values into a set of output data, the output data representing fracture dimensions and pressures as a function of pumping time, (f) displaying, transmitting, or printing the output data.

3. A method for monitoring or evaluating a fracture of a well, comprising:

(a) pumping a fracturing fluid into a wellbore, (b) obtaining a first data set, the first data set comprising the following:
time history of fluid volumes for pumping,
fluid properties, and
logs, (c) providing the first data set to a computer, the computer having a processor capable of executing instructions, the computer further having electronic storage means with stored equations comprising hydraulic fracturing relationships, (d) computing by said processor a first set of values by manipulating said first data set using said stored equations, (e) determining from said first set of values the dimensions of a hydraulic fracture using a mesh of elements, said dimensions including fracture dimensions and fluid pressures as a function of time, wherein the elements are capable of being only partially active, further wherein recalculation of fully active elements is not required during computing of said first set of values, (f) converting said first set of values into a set of output data, the output data representing fracture dimensions and pressures as a function of pumping time, (g) displaying the output data, and (h) monitoring the pumping step (a) to determine fracturing performance.

4. A method of evaluating a fracture of a well following a fracturing operation, comprising:

(a) fracturing a well, (b) obtaining a first data set, the first data set comprising the following data points obtained during step (a):
time history of fluid volumes for pumping,
fluid properties, and
logs, (c) providing the first data set to a computer, the computer having a processor capable of executing instructions, the computer further having electronic storage means with stored equations comprising hydraulic fracturing relationships, (d) computing by said processor a first set of values by manipulating said first data set using said stored equations, (e) determining from said first set of values the dimensions of a hydraulic fracture using a mesh of elements, said dimensions including fracture dimensions and fluid pressures as a function of time, wherein the elements are capable of being only partially active, further wherein recalculation of fully active elements is not required during computing of said first set of values, (f) converting said first set of values into a set of output data, the output data representing fracture dimensions and pressures as a function of pumping time, (g) displaying the output data.

5. An article of manufacture, comprising:

(a) magnetic storage means having encoded thereon instructions, (b) a computer, the computer having a processor, wherein the processor is operably connected to said magnetic storage means, (c) wherein data is provided representing the time history of fluid volumes, fluid properties, and proppant properties required to fracture a well of a reservoir, (d) the processor being adapted to calculate values that correlate to said data, the values representing physical properties related to the reservoir or well fracturing operations using fluids, the values being used to estimate fracturing fluid performance, (e) the processor being capable of processing such data using numerical methods that subdivide a fracture numerical mesh into elements for purposes of calculation, said elements being generally capable of adopting a status as fully active, partially active, or inactive for calculation purposes, further wherein recalculation of fully active elements is not required.

* * * * *

UNITED STATES PATENT AND TRADEMARK OFFICE

CERTIFICATE OF CORRECTION

PATENT NO. : 6,876,959 B1
APPLICATION NO. : 09/301961
DATED : April 5, 2005
INVENTOR(S) : Peirce et al.

It is certified that error appears in the above-identified patent and that said Letters Patent is hereby corrected as shown below:

On the title page item (54), and column 1, line 1:
(54) METHOD AND APPARATUS FOR HYDRAULIC FRACTIONING ANALYSIS AND DESIGN corrected as

(54) METHOD AND APPARATUS FOR HYDRAULIC FRACTURING ANALYSIS AND DESIGN

Signed and Sealed this

Twenty-seventh Day of January, 2009

John Doll

JOHN DOLL
*Acting Director of the United States Patent and Trademark Office*